US012427572B2

(12) United States Patent
Grueneberg et al.

(10) Patent No.: US 12,427,572 B2
(45) Date of Patent: Sep. 30, 2025

(54) METHOD FOR THE POWDER METALLURGICAL PRODUCTION OF A COMPONENT

(71) Applicant: Mahle International GmbH, Stuttgart (DE)

(72) Inventors: Heiko Grueneberg, Zell im Wiesental (DE); Alexander Jakob, Schopfheim (DE); Klaus Wintrich, Schopfheim (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 17/489,760

(22) Filed: Sep. 29, 2021

(65) Prior Publication Data

US 2022/0097134 A1 Mar. 31, 2022

(30) Foreign Application Priority Data

Sep. 30, 2020 (DE) ..... 102020212371.3

(51) Int. Cl.
*B22F 3/10* (2006.01)
*B22F 3/00* (2021.01)
(Continued)

(52) U.S. Cl.
CPC ..... *B22F 3/10* (2013.01); *B22F 3/004* (2013.01); *B22F 3/26* (2013.01); *B22F 7/008* (2013.01);
(Continued)

(58) Field of Classification Search
None
See application file for complete search history.

(56) References Cited

U.S. PATENT DOCUMENTS 2,753,858 A 7/1956 Honeyman et al.
4,472,350 A 9/1984 Urano
(Continued)

FOREIGN PATENT DOCUMENTS

CN 1324957 A * 12/2001
CN 103480849 A * 1/2014
(Continued)

OTHER PUBLICATIONS

CN 103480849 machine translation (Year: 2014).*
(Continued)

*Primary Examiner* — Keith Walker
*Assistant Examiner* — Stephani Hill
(74) *Attorney, Agent, or Firm* — Fishman Stewart PLLC

(57) ABSTRACT

A method for the powder metallurgical production of a component may include providing a mould, filling a first metallurgical powder into the mould such that an outer contact surface of the first metallurgical powder in the mould forms an angle of 55° to 65° with an axis of a future green product, and filling a second metallurgical powder that is distinct from the first metallurgical powder into the mould such that the second metallurgical powder adjoins the outer contact surface of the first metallurgical powder. The method may also include producing the green product out of the first metallurgical powder and the second metallurgical powder, and sintering the green product to produce the component.

9 Claims, 2 Drawing Sheets

(51) Int. Cl.

| | |
|---|---|
| ***B22F 3/26*** | (2006.01) |
| ***B22F 7/00*** | (2006.01) |
| ***B22F 7/02*** | (2006.01) |

(52) U.S. Cl.

CPC ..... *B22F 7/02* (2013.01); *B22F 2207/01* (2013.01); *B22F 2301/35* (2013.01)

(56) References Cited

U.S. PATENT DOCUMENTS

| | | | | |
|---|---|---|---|---|
| 5,566,373 | A | 10/1996 | Seimetz et al. | |
| 5,666,632 | A | 9/1997 | Maulik | |
| 2010/0196188 | A1 | 8/2010 | Kalss | |
| 2015/0322828 | A1* | 11/2015 | Kohler | C22C 38/04 277/502 |
| 2015/0352638 | A1 | 12/2015 | Steiner | |
| 2016/0160700 | A1* | 6/2016 | Takahashi | C22C 38/00 420/61 |
| 2016/0326919 | A1* | 11/2016 | Ikemi | F01L 3/18 |
| 2019/0070818 | A1* | 3/2019 | Bram | B30B 15/022 |
| 2019/0143415 | A1* | 5/2019 | Kohler | F16K 25/005 251/368 |
| 2019/0360366 | A1* | 11/2019 | Hashimoto | B22F 1/10 |
| 2019/0381570 | A1 | 12/2019 | Heckendorn | |
| 2020/0232354 | A1 | 7/2020 | Heckendorn et al. | |
| 2020/0284173 | A1* | 9/2020 | Oikawa | B22F 1/10 |
| 2021/0215071 | A1* | 7/2021 | Oikawa | C22C 38/00 |
| 2021/0362249 | A1 | 11/2021 | Boehnke | |

FOREIGN PATENT DOCUMENTS

| | | | | | |
|---|---|---|---|---|---|
| CN | 105102161 | A | | 11/2015 | |
| CN | 108588577 | A | * | 9/2018 | B22F 7/02 |
| CN | 110607491 | A | | 12/2019 | |
| CN | 110621485 | A | | 12/2019 | |
| CN | 118127416 | A | * | 6/2024 | |
| DE | 3320886 | A1 | | 12/1983 | |
| DE | 69404305 | T2 | | 1/1998 | |
| DE | 102017202585 | A1 | | 8/2017 | |
| JP | S589901 | A | | 1/1983 | |
| JP | 60147514 | A | * | 8/1985 | B32B 15/011 |
| JP | H10287941 | A | | 10/1998 | |
| JP | 11193403 | A | * | 7/1999 | |
| JP | 2005305530 | A | * | 11/2005 | |
| JP | 2009062560 | A | | 3/2009 | |
| JP | 2022035265 | A | * | 3/2022 | |
| WO | WO-2019221106 | A1 | * | 11/2019 | B22F 5/008 |
| WO | WO-2022059310 | A1 | * | 3/2022 | |

OTHER PUBLICATIONS

CN 1324957 machine translation (Year: 2001).*
JP 2022-035265 machine translation (Year: 2022).*
Merriam Webster transverse (Year: 2024).*
English abstract for JP-S589901.
German Search report for DE-102020212371.3, dated Jun. 7, 2021.
Chinese Search Report, CN202111150554.6, dated Mar. 31, 2024 (w_translation).
Chinese Search Report, CN202111150554.6, dated Apr. 1, 2024 (w_translation).

* cited by examiner

METHOD FOR THE POWDER METALLURGICAL PRODUCTION OF A COMPONENT

CROSS-REFERENCE TO RELATED APPLICATIONS

This application claims priority to German Patent Application No. DE 10 2020 212 371.3, filed on Sep. 30, 2020, the contents of which is hereby incorporated by reference in its entirety.

TECHNICAL FIELD

The present invention relates to a method for the powder metallurgical production of a component. The invention, furthermore, relates to an arrangement having a component and a structural body produced in such a manner.

BACKGROUND

For producing metallic or metal-containing components, metal powders are frequently employed from which in a suitable powder metallurgical method the component is produced in particular by sintering.

It is known to produce such components with metallurgical powders that are distinct from one another. Thus, different properties of the various powders can be combined. For example, it can be desirable to provide one of the powders, after the sintering, adjoining the other sintered powder in the future component. Under consideration here are such components which are subjected to load on their outside, wherein a less resistant sintered powder forms the core and a more resistant sintered powder the outside of the component.

For this purpose, a first metallurgical powder can be introduced into a mould. Following this, a second metallurgical powder can be introduced into the mould and be in contact with an outer contact surface of the first powder. Following this, the powders are compressed in order to produce a green product. The green product is subsequently sintered in order to produce the component. In the process, an undefined transition between the two powders and thus a mixing of the two powders can occur during the improvement of the powder. This leads to undesirable and disadvantageous properties of the future component.

Also known are methods in which the first powder is introduced into the mould and pre-compressed. Following this, the second powder is introduced into the mould in such a manner that the second powder is in contact with the outer contact surface of the first powder. Following this, both powders are compressed for producing the green product and subsequently sintered for producing the component. This leads to an improvement of the transition between the two powders, but also means an increased expenditure in producing the component.

SUMMARY

The present invention therefore deals with the object of stating for a method for the powder metallurgical production of a component of the type mentioned at the outset and for an arrangement having such a component and a structural body improved or at least other embodiments which are characterised by a simplified production and/or increased resistance.

According to the invention, this object is solved through the subject matter of the independent claim(s). Advantageous embodiments form the subject matter of the dependent claim(s).

The present invention is based on the general idea of providing, during the production of a component out of two different metallurgical powders, with which initially a first of the powders and subsequently a second of the powders is introduced into a mould, an angle in the transition region between the two powders between 55° and 65° with respect to an axis of a green product produced out of the powders. Intensive investigations have surprisingly shown that such an angle between the powders leads to a clearly defined transition of the first powder to the second powder in particular without a pre-compaction of the first powder, i.e. in particular a moulding of the first powder with a force of up to 65 MPa being necessary. Thus, the idea according to the invention with simplified production leads to a clearly defined transition between the two powders in the green product and thus to a clearly defined future component, which in particular has an improved mechanical stability.

According to the inventive idea, a mould is provided for producing the component. Initially, the first metallurgical powder is filled into the mould. This is performed in such a manner that an outer contact surface of the first powder in the mould forms an angle between 55° and 65° with an axis of the future green product. Following this, the second powder is filled into the mould. The filling of the second powder into the mould is performed in such a manner that the second powder adjoins the contact surface of the first powder. Following this, the green product is produced and, by sintering, the component produced out of the green product.

The production of the green product is practically performed by a compressing of the powder. Here, the powders are preferably compressed jointly. In other words, a pre-compressing of the first powder prior to filling the second powder into the mould is not necessary, while such could be conceivable.

The contact surface of the first powder forms an inner contact surface within the green product between the powders. Thus, the contact surface defines a boundary surface between the two powders and thus between different and interconnected portions of the future component produced out of the powders by the sintering.

For producing the component, a further treatment can be performed following the sintering of the green product. In particular it is conceivable that following the sintering a heat treatment is carried out. It is likewise conceivable that following the sintering a moulded part is created which is subsequently reworked to its final dimension and thus the component produced.

Particularly preferably, a rotation-symmetrical green product, preferentially in addition a rotation-symmetrical component is produced with the method according to the invention, which is rotation-symmetrical with respect to the axis. This leads to a particularly simple production of the component and a precise definition of the transition between the powders in the mould and in the green product and consequently the portions in the component.

Embodiments, in which the contact surface of the first powder forms an angle of approximately 60° with the axis, are considered advantageous. Such an angle has proved to be particularly advantageous with respect to a clear transition region between the powders. In particular, the angle amounts to between 58° and 62°.

In advantageous embodiments, the sintered second powder forms an outside of the component and consequently covers the sintered first powder at least partly. In particular, the sintered first powder and thus the first portion forms a core of the component, whereas the sintered second powder and thus the second portion forms the outside. In other words, the first portion of the component is the core of the component, whereas the second portion is the outside of the component. Thus it is possible in particular to select the first powder more cost-favourably, in particular less resistant than the second powder. In particular, the first powder can be selected as a carrier material and the second powder as a function material of the future component.

Here it is advantageous when the powders are selected in such a manner that the sintered second powder and thus the second portion has a higher wear resistance compared with the sintered first powder and thus the first portion. This makes possible a particularly cost-effective production of the component.

Generally, the component can be any.

Variants, in which the component is a tribologically loaded component, are considered advantageous. Here, preferably the sintered second powder and thus the second portion or the outside is preferably tribologically exposed in an associated arrangement.

In the arrangement, the component interacts with a further component wherein the further component for better distinction is referred to as structural body in the following. Here, the second portion and thus the sintered second powder in the arrangement are in tribological contact with the structural body.

It is conceivable to produce as component a ring, for example a piston ring, which interacts with a cylinder as structural body.

It is conceivable to produce as component a valve seed ring which interacts with a valve as structural body.

Here it is to be understood that besides the method for producing the component such an arrangement is also part of the scope of this invention.

Basically, the structural body can be produced from any material.

It is preferable when the structural body is based on iron and/or nickel.

Alternatively or additionally it is advantageous when the structural body is coated with a protective coating and/or nitrided.

Generally, the respective metallurgical powder can have any composition wherein it is preferable when the composition of the second powder has and/or has as a consequence an increased resistance compared with the composition of the second powder.

Embodiments, in which the first powder has the following composition, are considered advantageous: C: 0.3 to 1.8% by weight; Si: 0 to 1.8% by weight; S: 0 to 1.0% by weight; Mn: 0 to 1.0% by weight; Cr: 0 to 15.0% by weight; Mo: 0 to 2.5% by weight; Cu: 5 to 48% by weight; Ni: 0 to 3.5% by weight; W: 0 to 5.5% by weight; V: 0 to 2.0% by weight; remainder Fe and production-related contaminations.

In particular, the first powder has the following composition: C: 0.5 to 1.8% by weight; Si: 0 to 1.8% by weight; S: 0 to 1.0% by weight; Mn: 0 to 0.6% by weight; Cr: 3.0 to 15.0% by weight; Mo: 2.5 to 5.0% by weight; Cu: 12.0 to 20.0% by weight; Ni: 0 to 3.5% by weight; W: 0.5 to 5.5% by weight; V: 0.4 to 2.0% by weight; remainder Fe and production-related contaminations.

The first powder can also have the following composition: C: 0.5 to 1.5% by weight; Si: 0 to 0.8% by weight; S: 0 to 1.0% by weight; Mn: 0 to 1.0% by weight; Cr: 0 to 1.0% by weight; Mo: 0 to 1.0% by weight; Cu: 28.0 to 48.0% by weight; Ni: 0 to 1.0% by weight; remainder Fe and production-related contaminations.

Also conceivable is the following composition of the first powder: C: 0.3 to 1,3% by weight; Si: 0 to 0.8% by weight; S: 0 to 0.5% by weight; Mn: 0 to 1.0% by weight; Cr: 0 to 1.0% by weight; Mo: 0 to 2.0% by weight; Cu: 5.0 to 15.0% by weight; Ni: 0 to 3.5% by weight; remainder Fe and production-related contaminations.

Preferably, the second powder has the following composition: C: 0.7 to 1.8% by weight; Si: 0 to 1.8% by weight; Mn: 0 to 1.0% by weight; S: 0 to 0.5% by weight; Cr: 2.0 to 15.0% by weight; Mo: 2.5 to 18.0% by weight; V: 0.4 to 2.0% by weight; Cu: 10.0 to 20.0% by weight; W: 0.8 to 4.0% by weight; Co: 0 to 12.0% by weight; Ni: 0 to 3.5% by weight; remainder Fe and production-related contaminations.

The second powder can have the following composition, for example: C: 1.0 to 1.8% by weight; Si: 0.2 to 1.8% by weight; Mn: 0 to 0.6% by weight; S: 0 to 0.5% by weight; Cr: 10.0 to 15.0% by weight; Mo: 2.5 to 4.5% by weight; V: 0.4 to 1.0% by weight; Cu: 12.0 to 20.0% by weight; W: 0.8 to 1.5% by weight; Co: 0 to 2.0% by weight; Ni: 0 to 3.5% by weight; remainder Fe and production-related contaminations.

Alternatively, the second powder can have the following composition: C: 0.7 to 1.5% by weight; Si: 0 to 1.0% by weight; Mn: 0 to 1.0% by weight; S: 0 to 0.5% by weight; Cr: 2.0 to 4.0% by weight; Mo: 12.0 to 18.0% by weight; V: 1.0 to 2.0% by weight; Cu: 10.0 to 20.0% by weight; W: 2.0 to 4.0% by weight, Co: 8.0 to 12.0% by weight; Ni: 0 to 3.5% by weight; remainder Fe and production-related contaminations.

Preferably, the green product is infiltrated with copper or a copper alloy during the sintering, that is during the sintering operation. This leads to an improved mechanical stability of the component. In particular, pure copper or a copper alloy with a content of at least 70% by weight of copper is used.

Further important features and advantages of the invention are obtained from the sub-claims, from the drawings and from the associated figure description by way of the drawings.

It is to be understood that the features mentioned above and still to be explained in the following cannot only be used in the respective combinations stated, but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shown, in each case schematically.

DETAILED DESCRIPTION

Figure 1:
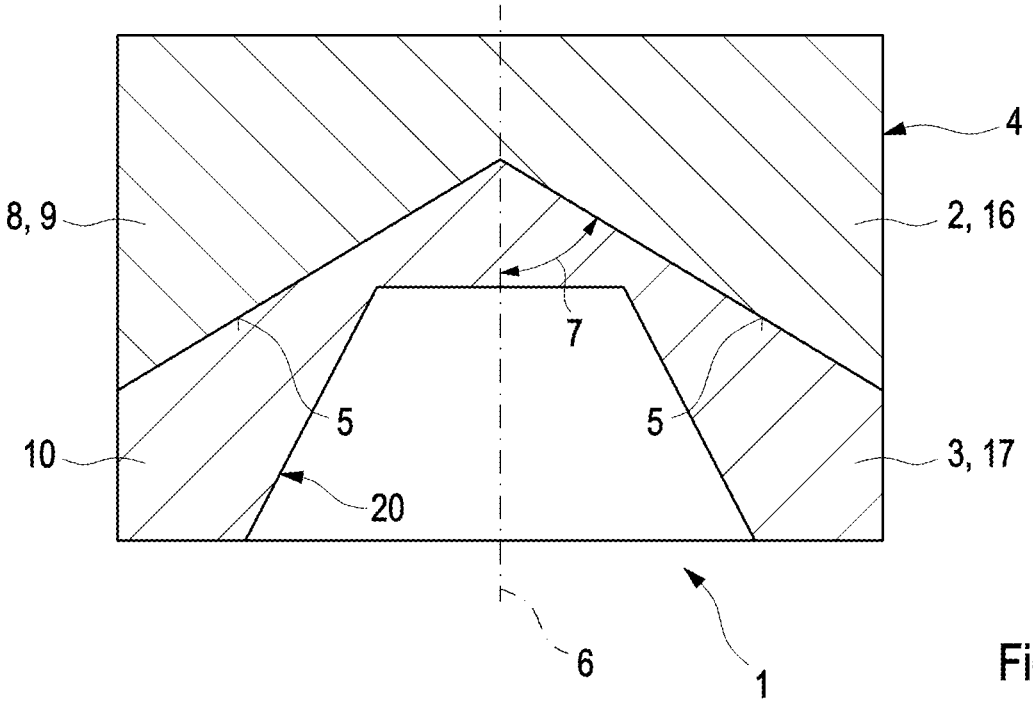
FIG. 1 shows a section through a green product having two metallurgical powders.
Figure 2:
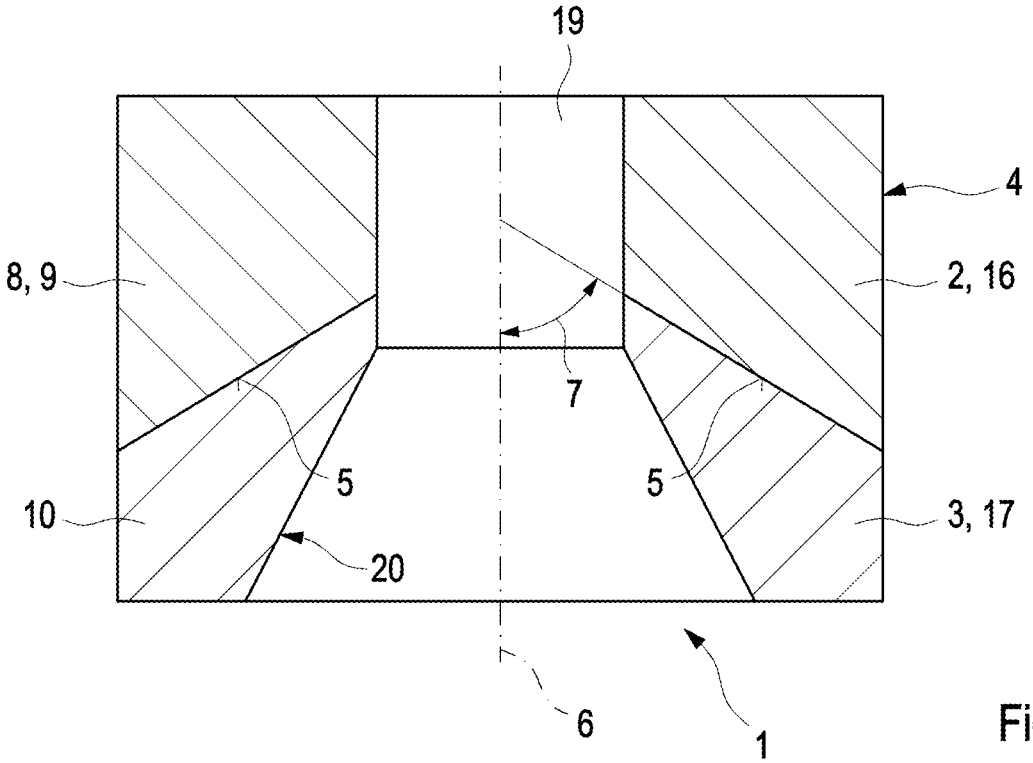
FIG. 2 shows a section through the green product in another exemplary embodiment.
Figure 3:
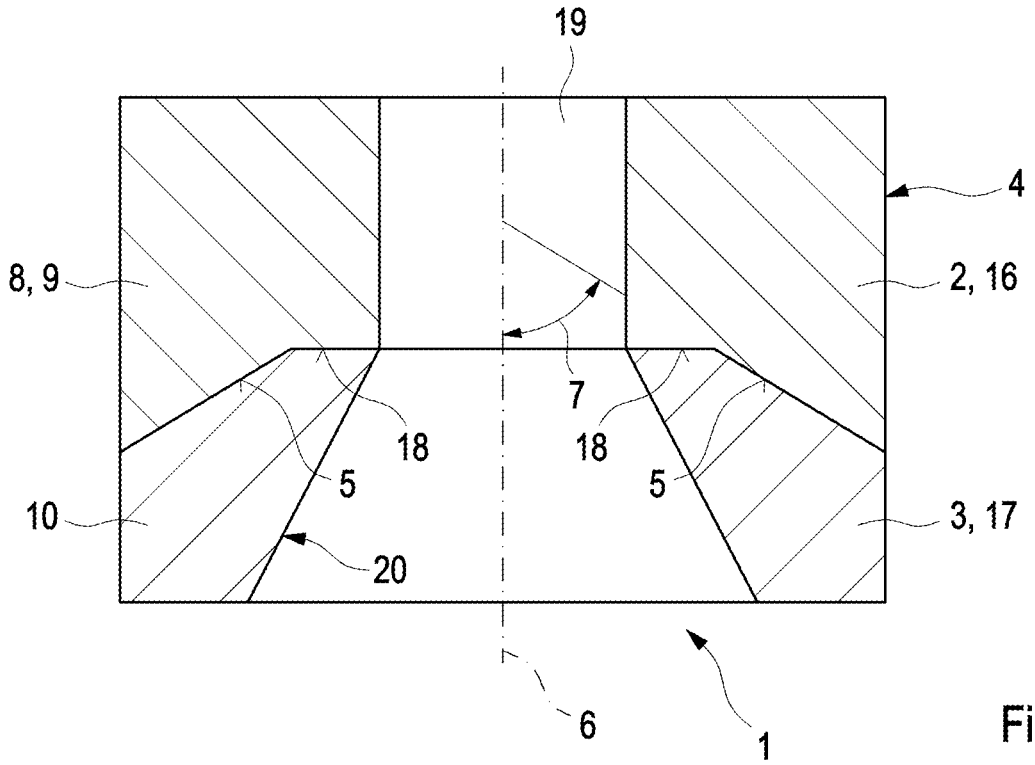
FIG. 3 shows a section through the green product in a further exemplary embodiment.
Figure 4:
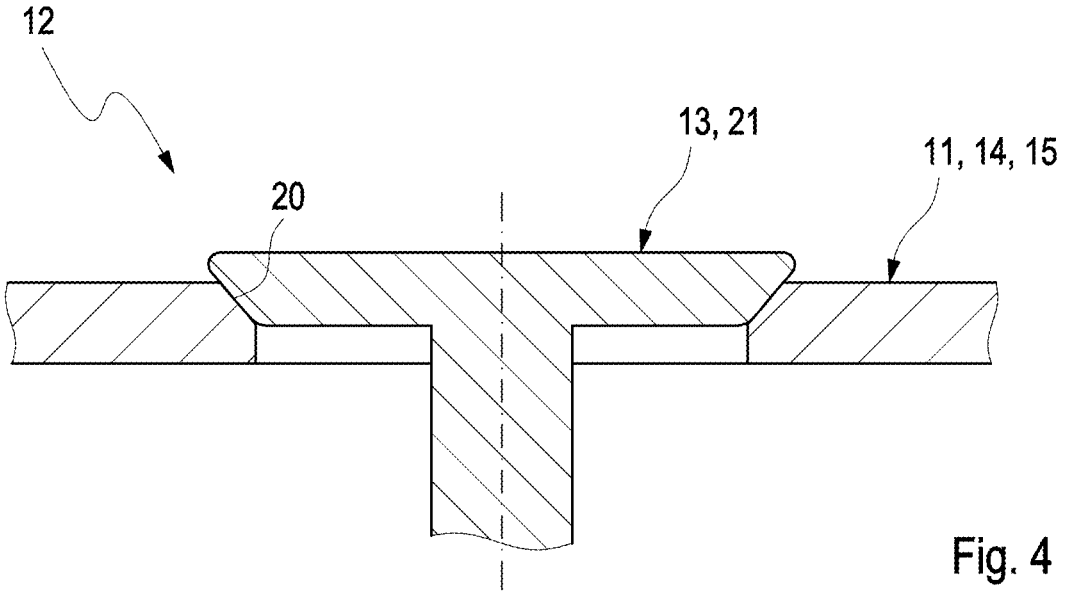
FIG. 4 shows a section through an arrangement having a component and a structural body produced out of the green product.

For producing a component 11 exemplarily shown in FIG. 4, a green product 1, such as is shown for example in the FIGS. 1 to 3, is initially produced.

For producing the green product 1, a first metallurgical powder 2 and a second metallurgical powder 3 that is distinct from the first metallurgical powder 2 are filled into a mould 4, wherein the FIGS. 1 to 3 each show a state in which both powders 2, 3 are already filled into the mould 4. Here, the first powder 2 is initially filled into the mould 4. This is performed in such a manner that an outer surface 5 of the first powder 2, in the following also referred to as contact surface 5, forms an angle 7 between 55° and 65°, preferably between 58° and 62°, particularly preferably 60° with an axis 6 of the green product 1, in particular and preferably also of the future component 11. Following this, the second powder 3 is filled into the mould 4 in such a manner that the second powder 3 adjoins the contact surface 5 and is in contact with the same.

Following this, the green product 1 is produced by jointly compressing the powders 2, 3. Following this, the green product 1 is sintered in order to produce the component 11. In the process it is conceivable to infiltrate the green product 1 during the sintering 1 with copper or a copper alloy with a content of at least 70% by weight. Following the sintering, the component 11 or a moulded part (not shown) produced from the green product 1 can be heat-treated. When a moulded part is produced out of the green product 1 the moulded part is reworked and thus brought to size in order to produce the component 11.

In the shown exemplary embodiments, the green product 1 and the future component 11 are rotation-symmetrical with respect to the axis 6.

There, the sintered first powder 2 in the component 11 forms a first portion 8 which serves as core 9 of the component 11. By contrast, the sintered second powder 3 forms a second portion 10 of the component 11 and is arranged outside on the component 11, thus forming an outside 20 of the component 11.

According to FIG. 4, the component 11 is preferentially such a component which in an associated arrangement 12 is in tribological contact with an associated component 13, which for better distinction is also referred to as structural body 13 in the following. The component 11 can be in particular a ring 14, for example, a valve seed ring 15. In the arrangement 12, the valve seed ring 15 is in tribological contact with a valve 21 as structural body 13.

Preferably, the second powder 3, which, sintered, forms the second loaded portion 10 of the component 11, is more resistant than the first powder 2. The first powder 2 or the sintered first powder 2 is a carrier material 16 and the second powder 3 or the sintered second powder 3 a function material 17 of the component 11.

The first powder 2 and thus the carrier material 16 can have the following composition: C: 0.3 to 1.8% by weight; Si: 0 to 1.8% by weight; S: 0 to 1.0% by weight; Mn: 0 to 1.0% by weight; Cr: 0 to 15.0% by weight; Mo: 0 to 2.5% by weight; Cu: 5 to 48% by weight; Ni: 0 to 3.5% by weight; W: 0 to 5.5% by weight; V: 0 to 2.0% by weight; remainder Fe and production-related contaminations.

The second powder 3 and thus the function material 17 can have the following composition: 0.7 to 1.8% by weight; Si: 0 to 1.8% by weight; Mn: 0 to 1.0% by weight; S: 0 to 0.5% by weight; Cr: 2.0 to 15.0% by weight; Mo: 2.5 to 18.0% by weight; V: 0.4 to 2.0% by weight; Cu: 10.0 to 20.0% by weight; W: 0.8 to 4.0% by weight; Co: 0 to 12.0% by weight; Ni: 0 to 3.5% by weight; remainder Fe and production-related contaminations.

The structural body 13 is preferentially based on iron and/or nickel. The structural body 13 can have a protective coating (not shown) and/or be nitrided.

In the shown exemplary embodiments, the contact surfaces 5 each run rotation-symmetrically with respect to the axis 6. In the exemplary embodiments of the FIGS. 1 and 2, the contact surface 5 forming the angle 7 between 55° and 65° with the axis 6 extends over the entire outer side of the first powder 2. Compared with this, this contact surface 5 is limited in the exemplary embodiment of FIG. 3, i.e. does not extend over the entire outer side of the first powder 2. In this exemplary embodiment, a flat side 18 of the first powder 2 adjoins the contact surface 5 forming an angle between 55° and 65° with the axis 6. Here, the flat side 18 is arranged on the inside of the contact surface 5 and smaller than the contact surface 5.

In the exemplary embodiments of the FIGS. 2 and 3, a recess 19 each is provided in the green product 1 and thus in the future component 11. Compared with this, no such recesses 19 are provided in the green product 1 and thus in the future component 11 in the exemplary embodiment of FIG. 1.

The invention claimed is:

1. A method for the powder metallurgical production of a component, comprising:

producing a green product from a first metallurgical powder and a second metallurgical powder that is distinct from the first metallurgical powder; and sintering the green product;

wherein producing the green product includes:

providing a mould;

filling the mould with the first metallurgical powder such that an outer contact surface of the first metallurgical powder in the mould defines an angle of 55° to 65° with an axis of the green product; and filling the mould with the second metallurgical powder such that the second metallurgical powder adjoins the outer contact surface of the first metallurgical powder;

wherein the first metallurgical powder has a composition including:

0.5 to 1.8% by weight of carbon (C);

0 to 1.8% by weight of silicon (Si);

0 to 1.0% by weight of sulfur(S);

0 to 0.6% by weight of manganese (Mn);

3.0 to 15.0% by weight of chromium (Cr);

2.5 to 5.0% by weight of molybdenum (Mo);

12 to 20% by weight of copper (Cu);

0 to 3.5% by weight of nickel (Ni);

0.5 to 5.5% by weight of tungsten (W);

0.4 to 2.0% by weight of vanadium (V); and a remainder of iron (Fe) and production-related contaminations; and wherein the second metallurgical powder has a composition including:

0.7 to 1.8% by weight of carbon (C);

0 to 1.8% by weight of silicon (Si);

0 to 1.0% by weight of manganese (Mn);

0 to 0.5% by weight of sulfur(S);

2.0 to 15.0% by weight of chromium (Cr);

2.5 to 18.0% by weight of molybdenum (Mo);

0.4 to 2.0% by weight of vanadium (V);

10.0 to 20.0% by weight of copper (Cu);

0.8 to 4.0% by weight of tungsten (W);

0 to 12.0% by weight of cobalt (Co);

0 to 3.5% by weight of nickel (Ni); and a remainder of iron (Fe) and production-related contaminations.

2. The method according to claim 1, wherein:

the sintered second metallurgical powder has a higher wear resistance than the sintered first metallurgical powder;

the mould is filled with the second metallurgical powder without pre-compacting the first metallurgical powder; and the angle formed by the contact surface and the axis is 58° to 62°.

3. A method for the powder metallurgical production of a component, comprising:

providing a mould;

filling a first metallurgical powder into the mould such that an outer contact surface of the first metallurgical powder in the mould forms an angle of 55° to 65° with an axis of a future green product;

filling a second metallurgical powder, which is distinct from the first metallurgical powder, into the mould such that the second metallurgical powder adjoins the outer contact surface of the first metallurgical powder;

producing the green product out of the first metallurgical powder and the second metallurgical powder; and sintering the green product to produce the component;

wherein the sintered second metallurgical powder has a higher wear resistance than the sintered first metallurgical powder;

wherein the first metallurgical powder has a composition including:

0.5 to 1.8% by weight of carbon (C);

0 to 1.8% by weight of silicon (Si);

0 to 1.0% by weight of sulfur(S);

0 to 0.6% by weight of manganese (Mn);

3.0 to 15.0% by weight of chromium (Cr);

2.5 to 5.0% by weight of molybdenum (Mo);

12 to 20% by weight of copper (Cu);

0 to 3.5% by weight of nickel (Ni);

0.5 to 5.5% by weight of tungsten (W);

0.4 to 2.0% by weight of vanadium (V); and a remainder of iron (Fe) and production-related contaminations; and wherein the second metallurgical powder has a composition including:

0.7 to 1.8% by weight of carbon (C);

0 to 1.8% by weight of silicon (Si);

0 to 1.0% by weight of manganese (Mn);

0 to 0.5% by weight of sulfur(S);

2.0 to 15.0% by weight of chromium (Cr);

2.5 to 18.0% by weight of molybdenum (Mo);

0.4 to 2.0% by weight of vanadium (V);

10.0 to 20.0% by weight of copper (Cu);

0.8 to 4.0% by weight of tungsten (W);

0 to 12.0% by weight of cobalt (Co);

0 to 3.5% by weight of nickel (Ni); and a remainder of iron (Fe) and production-related contaminations.

4. The method according to claim 3, wherein the component is rotation-symmetrical with respect to the axis.

5. The method according to claim 3, wherein the component is produced such that the sintered second metallurgical powder forms an outside of the component and at least partly covers the sintered first metallurgical powder.

6. The method according to claim 3, wherein the angle formed by the contact surface and the axis is 58° to 62°.

7. The method according to claim 3, wherein:

the component is a tribologically loaded component; and the sintered second metallurgical powder of the component is tribologically exposed and is carried by the sintered first metallurgical powder.

8. The method according to claim 3, wherein sintering the green product includes infiltrating the green product with at least one of copper and a copper alloy with a content of at least 70% by weight of copper.

9. The method according to claim 3, wherein the mould is filled with the second metallurgical powder without pre-compacting the first metallurgical powder.

* * * * *